US007422314B2

(12) United States Patent
Yokouchi

(10) Patent No.: US 7,422,314 B2
(45) Date of Patent: Sep. 9, 2008

(54) LIQUID EJECTION HEAD, IMAGE FORMING APPARATUS AND METHOD OF MANUFACTURING LIQUID EJECTION HEAD

(75) Inventor: Tsutomu Yokouchi, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 426 days.

(21) Appl. No.: 11/225,129

(22) Filed: Sep. 14, 2005

(65) Prior Publication Data

US 2006/0055742 A1 Mar. 16, 2006

(30) Foreign Application Priority Data

Sep. 15, 2004 (JP) ..... 2004-268546

(51) Int. Cl.
*B41J 2/045* (2006.01)

(52) U.S. Cl. ..... 347/68

(58) Field of Classification Search ..... 347/59, 347/68, 70–72

See application file for complete search history.

(56) References Cited

U.S. PATENT DOCUMENTS

| | | | | |
|---|---|---|---|---|
| 5,477,247 | A * | 12/1995 | Kanegae | 347/20 |
| 5,940,099 | A | 8/1999 | Karlinski | |
| 6,439,702 | B1 | 8/2002 | Karlinski | |
| 6,481,074 | B1 | 11/2002 | Karlinski | |
| 6,616,270 | B1 | 9/2003 | Miyata et al. | |
| 6,766,567 | B2 | 7/2004 | Karlinski | |
| 2003/0088969 | A1 | 5/2003 | Karlinski | |
| 2003/0206218 | A1 | 11/2003 | Miyata et al. | |

FOREIGN PATENT DOCUMENTS

| | | | |
|---|---|---|---|
| JP | 9-226114 | A | 9/1997 |
| JP | 2000-127379 | A | 5/2000 |
| JP | 2000-289201 | A | 10/2000 |
| JP | 2001-179973 | A | 7/2001 |
| JP | 2003-512211 | A | 4/2003 |
| WO | WO-01/30577 | A1 | 5/2001 |

* cited by examiner

*Primary Examiner*—An H Do
(74) *Attorney, Agent, or Firm*—Birch, Stewart, Kolasch & Birch, LLP

(57) ABSTRACT

The liquid ejection head includes: a plate which has a plurality of ejection ports which eject a liquid; a plurality of pressure chambers connected respectively to the ejection ports; a plurality of piezoelectric elements which respectively deform the pressure chambers, the piezoelectric elements being provided on a side of the pressure chambers opposite to a side on which the ejection ports are formed; a common liquid chamber which respectively supplies the liquid to the pressure chambers, the common liquid chamber being provided on the side of the pressure chambers opposite to the side on which the ejection ports are formed; and a plurality of wiring members which transfer a drive signal to the piezoelectric elements, the drive signal driving the piezoelectric elements for deforming the pressure chambers, wherein: the wiring members are formed so that at least a portion of each of the wiring members rises upward through the common liquid chamber in a substantially perpendicular direction with respect to a surface on which the piezoelectric elements are disposed; and the wiring members are connected to the piezoelectric elements by means of an adhesive comprising a plurality of conductive particles and a non-conductive resin.

19 Claims, 14 Drawing Sheets

LIQUID EJECTION HEAD, IMAGE FORMING APPARATUS AND METHOD OF MANUFACTURING LIQUID EJECTION HEAD

BACKGROUND OF THE INVENTION

1. Field of the Invention

The present invention relates to a liquid ejection head, an image forming apparatus and a method of manufacturing a liquid ejection head, and more particularly to a liquid ejection head, an image forming apparatus and a method of manufacturing a liquid ejection head that can achieve a high-density arrangement of ejection ports ejecting a liquid while also permitting ejection of high-viscosity liquid.

2. Description of the Related Art

An inkjet type image forming apparatus has a print head (liquid ejection head) in which a plurality of nozzles (ejection ports) are arranged in the form of a matrix, and it forms an image on a recording medium by ejecting ink droplets from the nozzles onto the recording medium.

According to an internal structure of a conventional print head, it is known that a plurality of pressure chambers connected to a plurality of nozzles; a common liquid chamber which stores an ink; a plurality of ink supply ports which supply the ink from the common liquid chamber to the pressure chambers; and the nozzles are disposed on the same side of a diaphragm which forms one surface of the pressure chambers. Those piezoelectric elements are disposed on the opposite side to the diaphragm. When the ink is supplied from the common liquid chamber to the pressure chambers and an electrical signal corresponding to the image data is applied to a piezoelectric element, then the piezoelectric element is driven and the diaphragm forming a portion of the corresponding pressure chamber is caused to deform. Thereby, since the volume of the pressure chamber decreases, then the ink inside the pressure chamber is ejected from the nozzle in the form of an ink droplet. When the ink droplet lands on the recording medium, it forms a dot on the recording medium. By combining dots of this kind, an image is formed on the recording medium.

In recent years, there have been demands for improved image quality in inkjet type image forming apparatuses. In order to improve image quality, it is necessary for reducing the size of the ink droplets ejected from the nozzles, by reducing the diameter of the nozzles, while also increasing the number of pixels per image by arranging the nozzles at a high density in the print head. Accordingly, in the prior art, various technologies have been proposed with the aim of increasing nozzle density (see Japanese Patent Application Publication Nos. 9-226114, 2001-179973, 2000-127379, 2000-289201, and 2003-512211, for example).

Japanese Patent Application Publication No. 9-226114 discloses a print head having a structure in which a plurality of holes for supplying ink are formed in a diaphragm, which a reservoir (common liquid chamber) is disposed on the opposite side of the diaphragm with respect to the nozzles.

Japanese Patent Application Publication No. 2001-179973 discloses a print head having a structure in which an ink supply section (common liquid chamber) is provided on the piezoelectric element side of a diaphragm, which an ink supply port is formed on the outside region of a pressure generating chamber (pressure chamber) of a diaphragm.

Japanese Patent Application Publication No. 2000-127379 discloses a print head having a reservoir section (common liquid chamber) formed on a surface on which piezoelectric elements are formed.

Japanese Patent Application Publication No. 2000-289201 discloses a print head in which piezoelectric elements are disposed on the side of pressure chambers adjacent to the nozzles, and a substrate (wiring layer) is disposed on the opposite side with respect to the nozzles.

Japanese Patent Application Publication No. 2003-512211 discloses a print head in which an ink supply layer comprised by a porous member for supplying the ink to pressure chambers is disposed between a nozzle layer in which nozzles are formed, and a cavity layer formed with ink cavities (pressure chambers). According to this reference, a plurality of piezoelectric elements are disposed on a displacement plate (diaphragm) which constitutes the ceiling of the ink cavities, a plurality of wiring members are provided from the piezoelectric elements in a substantially perpendicular direction with respect to the nozzle surface, and a substrate (wiring layer) is disposed at the ends of those wiring members.

However, if the density of the nozzles is increased in a conventional print head composition, there is a problem in that the electrical wires cannot be patterned onto the same surface as in the prior art, due to the increase in the number of electrical wires, such as the wires of the piezoelectric elements.

For example, the electrical wires of the print heads disclosed in Japanese Patent Application Publication Nos. 9-226114 and 2001-179973 are formed on a diaphragm. Thereby, when the nozzles are formed to high density, it is difficult to ensure sufficient space for the electrical wires.

Furthermore, the wiring of the print head disclosed in Japanese Patent Application Publication No. 2000-127379 is formed by wire-bonding, film formation, or the like. However, the wiring does not envisage a matrix-type nozzle arrangement, and hence it is difficult to position wiring of this kind at high density.

In the print head disclosed in Japanese Patent Application Publication No. 2000-289201, since an electrical wiring layer is provided on the opposite side to the piezoelectric elements with respect to the pressure chambers, then sufficient space is ensured for the electrical wiring. However, electrodes (aluminum plugs) for connecting the piezoelectric elements with the wiring layer are formed in the laminated plates which constitute the print head. Therefore, when the density of the nozzles is increased, it is necessary for reserving a larger space for the electrodes, and hence there are restrictions on the design of the common liquid chamber provided in the print head. For example, in the case in which the common liquid chamber is reduced in size, when a large number of nozzles are driven at a high frequency, the ink supply from the common liquid chamber to the respective pressure chambers cannot keep up with the demand, and hence it becomes impossible to eject ink droplets from the nozzles.

In the print head disclosed in Japanese Patent Application Publication No. 2003-512211, since a common liquid chamber (ink manifold) which accumulates ink to be supplied to the ink supply layer is provided on the opposite side to the wiring layer with respect to the wiring members, the flow path for supplying ink to the pressure chambers from the common liquid chamber via the ink supply layer is long. Therefore, when the density of the nozzles is increased, there is a risk that the speed of ink supply will not be sufficient. In particular, since the ink supply layer is constituted by a porous member, the print head is not suitable for ejection of high-viscosity ink. Additionally, since the common liquid chamber is disposed as described above, no consideration is given to insulating the wiring members with respect to liquid.

SUMMARY OF THE INVENTION

The present invention was devised with the foregoing circumstances in view, an object thereof being to provide a liquid ejection head, an image forming apparatus, and a method of manufacturing a liquid ejection head that the bonding sections between piezoelectric elements and wiring members can have reliable electrical conductions and a reliable insulation against liquid, when wiring members are provided in such a manner that the wiring members pass through a common liquid chamber.

In order to attain the aforementioned object, the present invention is directed to a liquid ejection head comprising: a plate which has a plurality of ejection ports which eject a liquid; a plurality of pressure chambers connected respectively to the ejection ports; a plurality of piezoelectric elements which respectively deform the pressure chambers, the piezoelectric elements being provided on a side of the pressure chambers opposite to a side on which the ejection ports are formed; a common liquid chamber which supplies the liquid respectively to the pressure chambers, the common liquid chamber being provided on the side of the pressure chambers opposite to the side on which the ejection ports are formed; and a plurality of wiring members which transfer a drive signal to the piezoelectric elements, the drive signal driving the piezoelectric elements for deforming the pressure chambers, wherein: the wiring members are formed so that at least one portion of each of the wiring members rises upward through the common liquid chamber in a substantially perpendicular direction with respect to a surface on which the piezoelectric elements are disposed; and the wiring members are connected to the piezoelectric elements by means of an adhesive comprising a plurality of conductive particles and a non-conductive resin.

According to the present invention, in the case in which at least one portion of each of the wiring members is disposed so as to rise up through the common liquid chamber, since an adhesive comprising conductive particles and a non-conductive resin is used in the bonding process, then it is possible to ensure a reliable electrical connection in the bonding sections while also guaranteeing insulation with respect to the liquid, even if the bonding sections between the wiring members and the piezoelectric elements come into contact with the liquid.

The inside of the wiring member is contributed by a conductive body, and the outside of the wiring member is contributed by an insulating body for insulating against the liquid. Preferably, the insulating body is contributed by a film coating.

Herein, the term "at least one portion of each of the wiring members" naturally includes a condition in which the wiring members rise up through the common liquid chamber in isolation, and also includes a mode in which one portion of each of the wiring members is buried in the side walls of the common chamber and makes contact with the liquid inside the common liquid chamber.

The present invention is also directed to the liquid ejection head wherein the conductive particles have elasticity.

According to the present invention, since an adhesive containing conductive particles having elasticity is used, then it is possible to smooth out manufactural variations in the wiring members, piezoelectric elements, wiring layer, and the like when assembling the liquid ejection head. Therefore, it is possible to reduce damage to the piezoelectric elements caused by manufactural variations.

The present invention is also directed to the liquid ejection head wherein a Young's modulus of the conductive particles is lower than a Young's modulus of the wiring members.

According to the present invention, since the conductive particles are principally deformed when bonding by means of an adhesive containing a plurality of conductive particles, it is possible to prevent deformation or disconnection of the wiring members, or the like.

The present invention is also directed to the liquid ejection head wherein each of the conductive particles has a structure in which a surface of an elastic body is coated with a metal thin film.

According to the present invention, the Young's modulus of the conductive particles is determined by the elastic body forming the interior part of the conductive particles, and the conductivity of the conductive particle is determined by the metallic thin film forming the surface of the conductive particles. Accordingly, since it is possible to respectively set the Young's modulus and the conductivity relating to the conductive particles, then it is possible to increase a flexibility of designing the conductive particles contained in the adhesive.

The present invention is also directed to the liquid ejection head wherein: a diameter of each of the conductive particles is smaller than an opening diameter of each of the ejection ports; the diameter of each of the conductive particles is smaller than a diameter of a leading portion of each of the supply ports, the leading portion being portion which leads from the common liquid chamber to each of the pressure chambers in each of the supply ports; and the diameter of each of the conductive particles is greater than a surface roughness of the wiring members.

According to the present invention, even if a conductive particle has floated up into the liquid accumulated inside the common liquid chamber, or the like, it is possible to prevent blocking of the supply ports or ejection ports, while also ensuring sealing properties and conductivity in the bonding sections of the wiring members.

The present invention is also directed to the liquid ejection head wherein at least one end of an electrode section in the wiring members has a broadened shape.

According to the present invention, since the ends of the electrode sections of the wiring members are able to make contact with a plurality of conductive particles, the conductivity in the bonding sections can be improved.

The present invention is also directed to the liquid ejection head wherein the wiring members are formed so as to rise upward from the piezoelectric elements or a vicinity of the piezoelectric elements.

Accordingly, the density of the ejection ports can be increased.

The present invention is also directed to the liquid ejection head wherein: the ejection ports are two-dimensionally arranged; and the wiring members are arranged two-dimensionally on a surface in which the piezoelectric elements are disposed.

Thereby, it is possible to further increase the density of the ejection ports, while also ensuring the positioning of the wiring members and reducing the fluid resistance inside the common liquid chamber.

In order to attain the aforementioned object, the present invention is directed to an image forming apparatus comprising a liquid ejection head which comprises: a plate which has a plurality of ejection ports which eject a liquid; a plurality of pressure chambers connected respectively to the ejection ports; a plurality of piezoelectric elements which respectively deform the pressure chambers, the piezoelectric elements being provided on a side of the pressure chambers opposite to a side on which the ejection ports are formed; a common liquid chamber which supplies the liquid respectively to the pressure chambers, the common liquid chamber being provided on the side of the pressure chambers opposite to the side on which the ejection ports are formed; and a plurality of wiring members which transfer a drive signal to the piezoelectric elements, the drive signal driving the piezoelectric elements for deforming the pressure chambers, wherein: the wiring members are formed so that at least one portion of each of the wiring members rises upward through the common liquid chamber in a substantially perpendicular direction with respect to a surface on which the piezoelectric elements are disposed; and the wiring members are connected to the piezoelectric elements by means of an adhesive comprising a plurality of conductive particles and a non-conductive resin.

The present invention is also directed to the image forming apparatus wherein the conductive particles have elasticity.

The present invention is also directed to the image forming apparatus wherein a Young's modulus of the conductive particles is lower than a Young's modulus of the wiring members.

The present invention is also directed to the image forming apparatus wherein each of the conductive particles has a structure in which a surface of an elastic body is coated with a metal thin film.

The present invention is also directed to the image forming apparatus wherein: a diameter of each of the conductive particles is smaller than an opening diameter of each of the ejection ports; the diameter of each of the conductive particles is smaller than a diameter of a leading portion of each of the supply ports, the leading portion being portion which leads from the common liquid chamber to each of the pressure chambers in each of the supply ports; and the diameter of each of the conductive particles is greater than a surface roughness relating to the wiring members.

The present invention is also directed to the image forming apparatus wherein at least one end of an electrode section in the wiring members has a broadened shape.

The present invention is also directed to the image forming apparatus wherein the wiring members are formed so as to rise upward from the piezoelectric elements or a vicinity of the piezoelectric elements.

The present invention is also directed to the image forming apparatus wherein: the ejection ports are two-dimensionally arranged; and the wiring members are arranged two-dimensionally on a surface in which the piezoelectric elements are disposed.

According to the present invention, electrical connections can be ensured in the bonding sections of the wiring members in the liquid ejection head, while also ensuring insulation with respect to the liquid. Therefore, since the density of the liquid ejection head can be increased, and ejection of high-viscosity liquid, or high-frequency ejection, can be carried out more dependably, it is possible to form images of high quality.

In order to attain the aforementioned object, the present invention is directed to a method of manufacturing a liquid ejection head comprising the steps of: causing a plate to form a plurality of ejection ports which eject a liquid; providing a plurality of pressure chambers which are connected respectively to the ejection ports; providing a plurality of piezoelectric elements on a side of the pressure chambers opposite to a side on which the ejection ports are formed; providing a common liquid chamber on the side of the pressure chambers opposite to the side on which the ejection ports are formed, the common liquid chamber supplying the liquid respectively to the pressure chambers; forming a plurality of wiring members in such a manner that at least one portion of each of the wiring members rises upward through the common liquid chamber in a substantially perpendicular direction with respect to a surface on which the piezoelectric elements are disposed, from the piezoelectric elements or a vicinity of the piezoelectric elements; and verifying that electrical connections are established between electrode sections of the wiring members and the piezoelectric elements before hardening of the adhesive, when the wiring members are bonded with the piezoelectric elements by means of an adhesive comprising a plurality of conductive particles and a non-conductive resin.

According to the present invention, since the electrical connections are confirmed before the adhesive has hardened, then it is possible to improve the production yield of the liquid ejection head.

As described above, according to the present invention, in the case in which at least a portion of each of the wiring members is disposed so as to rise up through the common liquid chamber, an adhesive comprising conductive particles and a non-conductive resin is used in the bonding process, and therefore, it is possible to ensure a reliable electrical connection in the bonding sections, while also guaranteeing insulation with respect to the liquid, even if the bonding sections between the wiring members and the piezoelectric elements make contact with the liquid.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
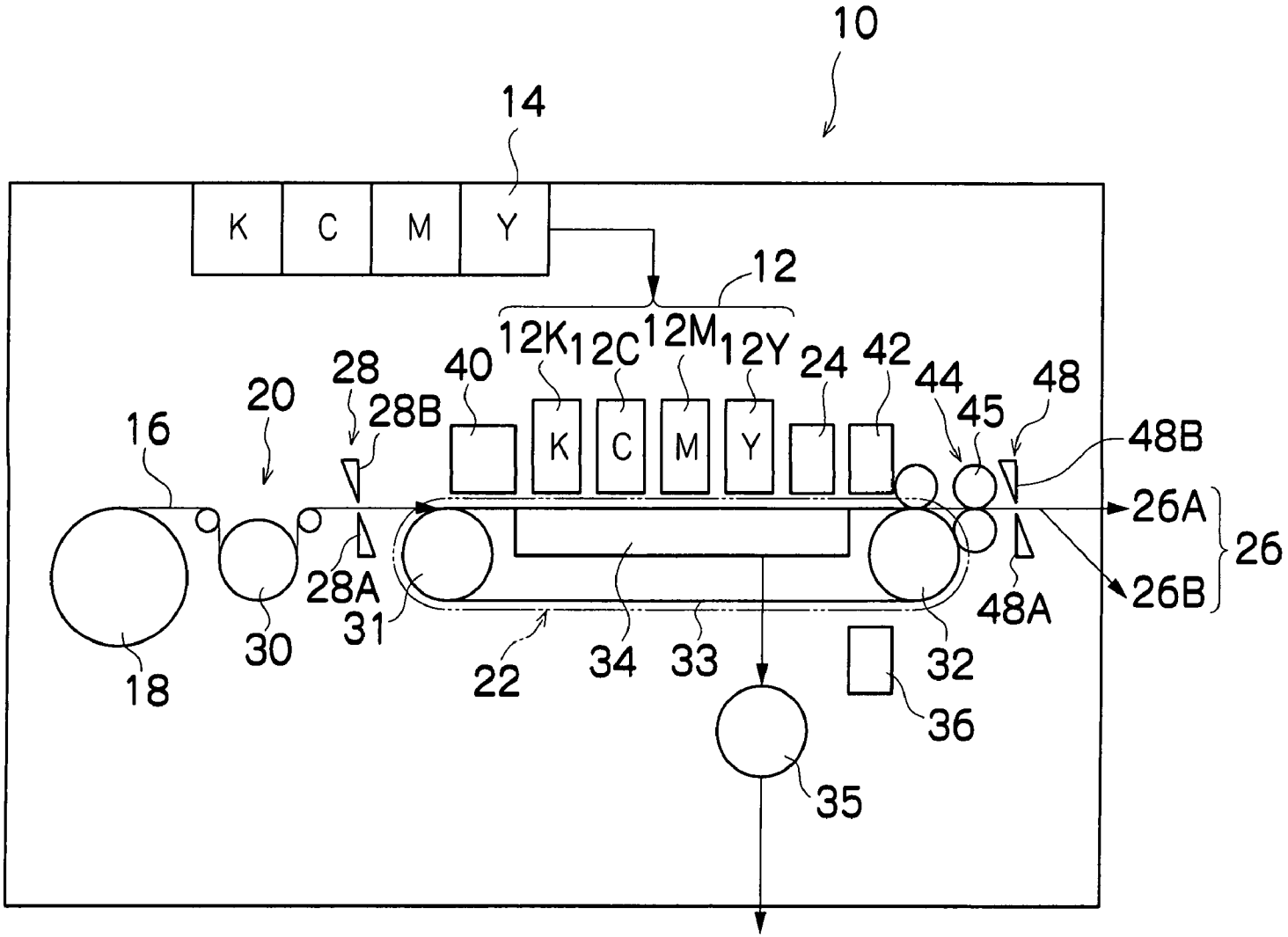
FIG. 1 is a general schematic drawing of an inkjet recording apparatus as an image forming apparatus according to an embodiment of the present invention.

FIG. 1 is a general schematic drawing of an inkjet recording apparatus as an image forming apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks of K, C, M, and Y to be supplied to the print heads 12K, 12C, 12M, and 12Y; a paper supply unit 18 for supplying recording paper 16; a decurling unit 20 for removing curl in the recording paper 16 supplied from the paper supply unit 18; a suction belt conveyance unit 22 disposed facing the nozzle face (ink-droplet ejection face) of the printing unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, of which length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction restrictors (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and this suction chamber 34 provides suction with a fan 35 to generate a negative pressure, thereby holding the recording paper 16 onto the belt 33 by suction. The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The printing unit 12 is a so-called "full line head" in which a line head having a length corresponding to the maximum paper width is arranged in a direction (main scanning direction) that is perpendicular to the paper conveyance direction (sub-scanning direction).

More specifically, the print heads 12K, 12C, 12M, and 12Y forming the printing unit 12 are constituted by line heads in which a plurality of ink ejection ports (nozzles) are arranged through a length exceeding at least one edge of the maximum size recording paper 16 intended for use with the inkjet recording apparatus 10.

The print heads 12K, 12C, 12M, and 12Y corresponding to respective ink colors are disposed in the order, black (K), cyan (C), magenta (M), and yellow (Y), from the upstream side (left-hand side in FIG. 1), following the direction of conveyance of the recording paper 16 (the paper conveyance direction). A color print can be formed on the recording paper 16 by ejecting the inks from the print heads 12K, 12C, 12M, and 12Y, respectively, onto the recording paper 16 while conveying the recording paper 16.

The printing unit 12, in which the full-line heads covering the entire width of the paper are thus provided for the respective ink colors, can record an image over the entire surface of the recording paper 16 by performing the action of moving the recording paper 16 and the printing unit 12 relatively to each other in the paper conveyance direction (sub-scanning direction) just once (in other words, by means of a single sub-scan). Higher-speed printing is thereby made possible and productivity can be improved in comparison with a shuttle type head configuration in which a recording head moves reciprocally in a direction (main scanning direction) which is perpendicular to the paper conveyance direction (sub-scanning direction).

Here, the terms "main scanning direction" and "sub-scanning direction" are used in the following senses. More specifically, in a fill-line head comprising rows of nozzles that have a length corresponding to the entire width of the recording paper, "main scanning" is defined as printing one line (a line formed of a row of dots, or a line formed of a plurality of rows of dots) in the breadthways direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other. The direction in which sub-scanning is performed is called the sub-scanning direction. Consequently, the conveyance direction of the reference point is the sub-scanning direction and the direction perpendicular to same is called the main scanning direction.

Although the configuration with the KCMY four standard colors is described in the present embodiment, combinations of the ink colors and the number of colors are not limited to those. Light inks or dark inks can be added as required. For example, a configuration is possible in which print heads for ejecting light-colored inks such as light cyan and light magenta are added.

As shown in FIG. 1, the ink storing and loading unit 14 has tanks for storing inks of the colors corresponding to the respective print heads 12K, 12C, 12M, and 12Y, and each tank is connected to a respective print head 12K, 12C, 12M, and 12Y, via a tube channel (not shown). Moreover, the ink storing and loading unit 14 also comprises a notifying device (display device, alarm generating device, or the like) for generating a notification if the remaining amount of ink has become low, as well as having a mechanism for preventing incorrect loading of the wrong colored ink.

The print determination unit 24 has an image sensor for capturing an image of the ink-droplet deposition result of the printing unit 12, and functions as a device to check for ejection defects such as clogs of the nozzles in the printing unit 12 from the ink-droplet deposition results evaluated by the image sensor (line sensor).

The print determination unit 24 of the present embodiment is configured with at least a line sensor having rows of photoelectric conversion elements with a width that is greater than the ink-droplet ejection width (image recording width) of the print heads 12K, 12C, 12M, and 12Y. This line sensor has a color separation line CCD sensor including a red (R) sensor row composed of photoelectric conversion elements (pixels) arranged in a line provided with an R filter, a green (G) sensor row with a G filter, and a blue (B) sensor row with a B filter. Instead of a line sensor, it is possible to use an area sensor composed of photoelectric conversion elements which are arranged two-dimensionally.

The print determination unit 24 reads a test pattern image printed by the print heads 12K, 12C, 12M, and 12Y for the respective colors, and determines the ejection of each head. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (in other words, the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown, the paper output unit 26A for the target prints is provided with a sorter for collecting prints according to print orders.

Description of Control System

Figure 2:
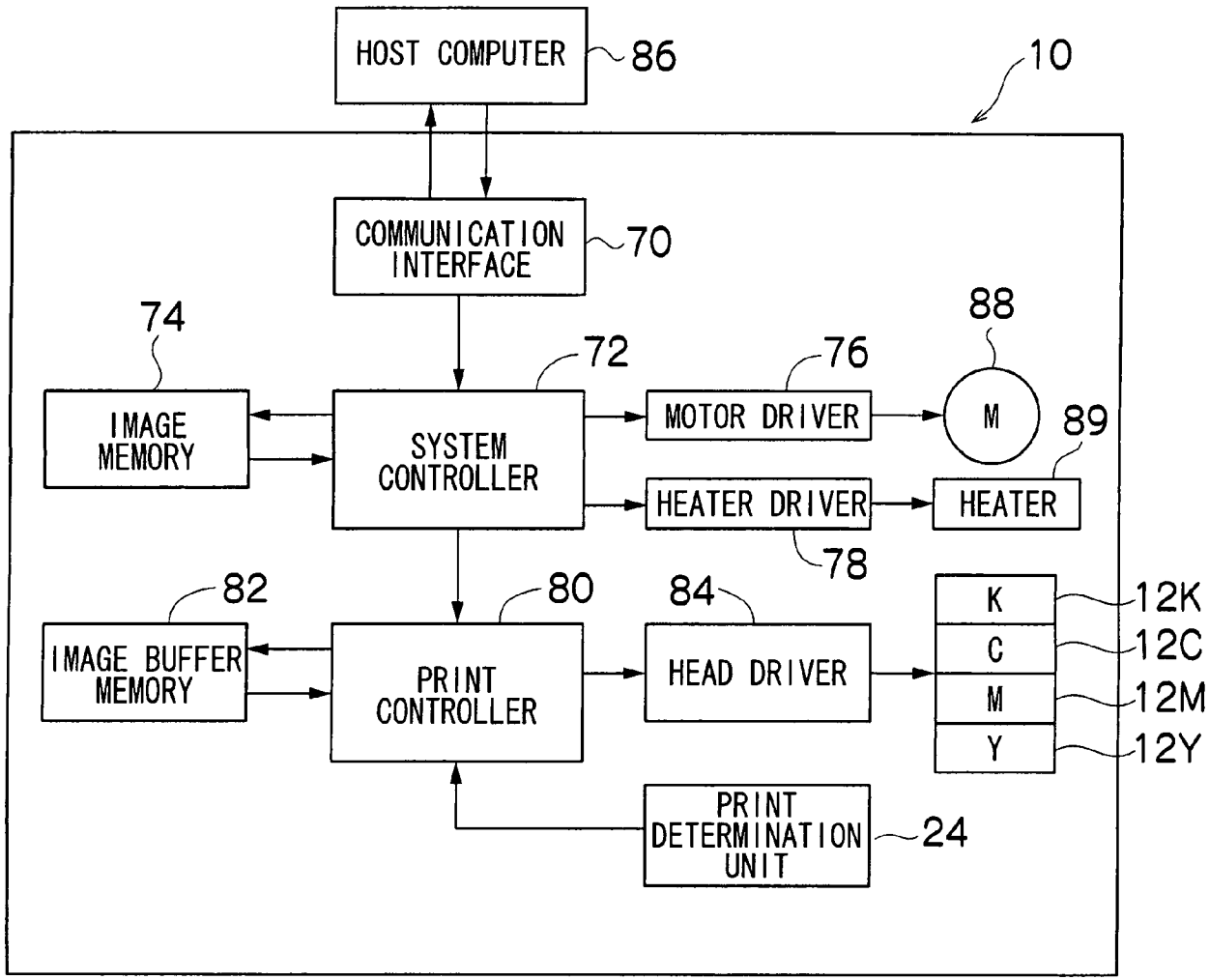
FIG. 2 is a principal block diagram showing a system composition of the inkjet recording apparatus.

FIG. 2 is a principal block diagram showing a system configuration of the inkjet recording apparatus 10. The inkjet recording apparatus 10 comprises a communications interface 70, a system controller 72, an image memory 74, a motor driver 76, a heater driver 78, a print controller 80, an image buffer memory 82, a head driver 84, and the like.

The communications interface 70 is an interface unit for receiving image data sent from a host computer 86. A serial interface such as USB, IEEE1394, Ethernet, wireless network, or a parallel interface such as a Centronics interface may be used as the communications interface 70. A buffer memory (not shown) may be mounted in this portion in order to increase the communication speed. The image data sent from the host computer 86 is received by the inkjet recording apparatus 10 through the communications interface 70, and is temporarily stored in the image memory 74. The image memory 74 is a storage device for temporarily storing images inputted through the communications interface 70, and data is written and read to and from the image memory 74 through the system controller 72. The image memory 74 is not limited to a memory composed of semiconductor elements, and a hard disk drive or another magnetic medium may be used.

The system controller 72 is a control unit for controlling the various sections, such as the communications interface 70, the image memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the image memory 74, or the like, it also generates a control signal for controlling the motor 88 of the conveyance system and the heater 89.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated control signal (print data) to the head driver 84. Prescribed signal processing is carried out in the print controller 80, and the ejection amount and the ejection timing of the ink droplets from the respective print heads 12K, 12C, 12M, and 12Y are controlled via the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 2 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the piezoelectric elements of the print heads 12K, 12C, 12M, and 12Y of the respective colors KCMY according to print data supplied by the print controller 80. The head driver 84 can be provided with a feedback control system for maintaining constant drive conditions for the print heads 12K, 12C, 12M, and 12Y.

The print determination unit 24 is a block that includes the line sensor (not shown) as described above with reference to FIG. 1, reads the image printed on the recording paper 16, determines the print conditions (presence of the ejection, variation in the dot formation, and the like) by performing desired signal processing, or the like, and provides the determination results of the print conditions to the print controller 80.

As necessary, the print controller 80 performs various corrections relating to the print heads 12K, 12C, 12M, and 12Y, according to the information obtained by the print determination unit 24.

Structure of Print Head

Figure 3:
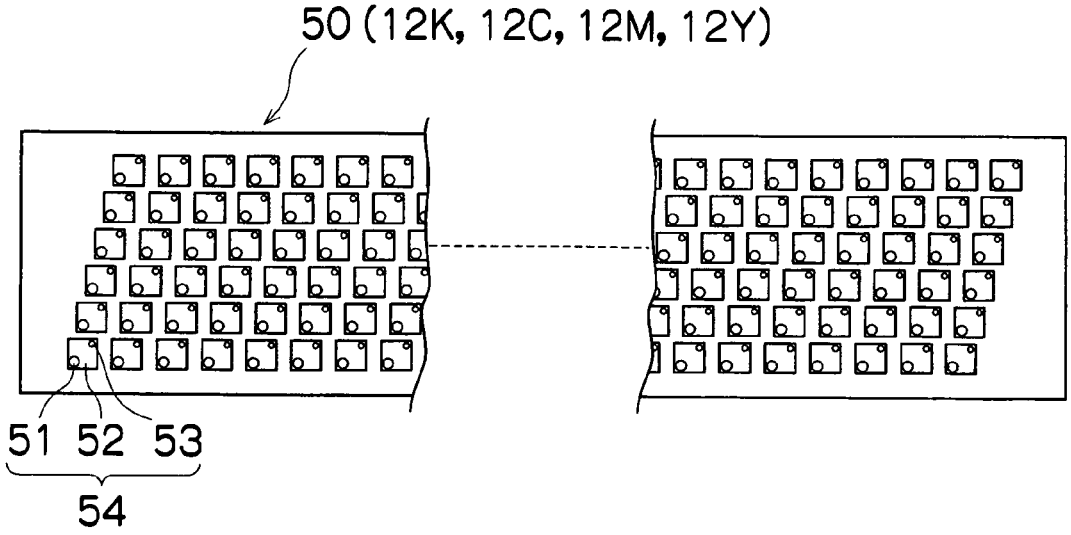
FIG. 3 is a plan perspective diagram showing an example of the structure of a print head.

Next, the structure of the print heads 12K, 12C, 12M, and 12Y will be described. The print heads 12K, 12C, 12M, and 12Y provided for the respective ink colors each have the same structure, and a print head forming a representative example of these print heads is indicated by the reference numeral 50. FIG. 3 shows a plan view perspective diagram of the print head 50.

As shown in FIG. 3, the print head 50 achieves a high density arrangement of nozzles 51 by using a two-dimensional staggered matrix array of pressure chamber units 54, each constituted by a nozzle 51 for ejecting ink droplets, a pressure chamber 52 for applying pressure to the ink in order to eject ink, and an ink supply port 53 for supplying ink to the pressure chamber 52.

There are no particular limitations on the size of the nozzle arrangement in a print head 50 of this kind, but as one example, 2400 npi can be achieved by arranging nozzles 51 in 48 lateral rows (21 mm) and 600 vertical columns (305 mm).

In the example shown in FIG. 3, each of the pressure chambers 52 has an approximately square planar shape when viewed from above, but the planar shape of the pressure chambers 52 is not limited to a square shape. As shown in FIG. 3, a nozzle 51 is formed at one end of the diagonal of a pressure chamber 52, and an ink supply port 53 is provided at the other end of the pressure chamber 52.

Figure 4:
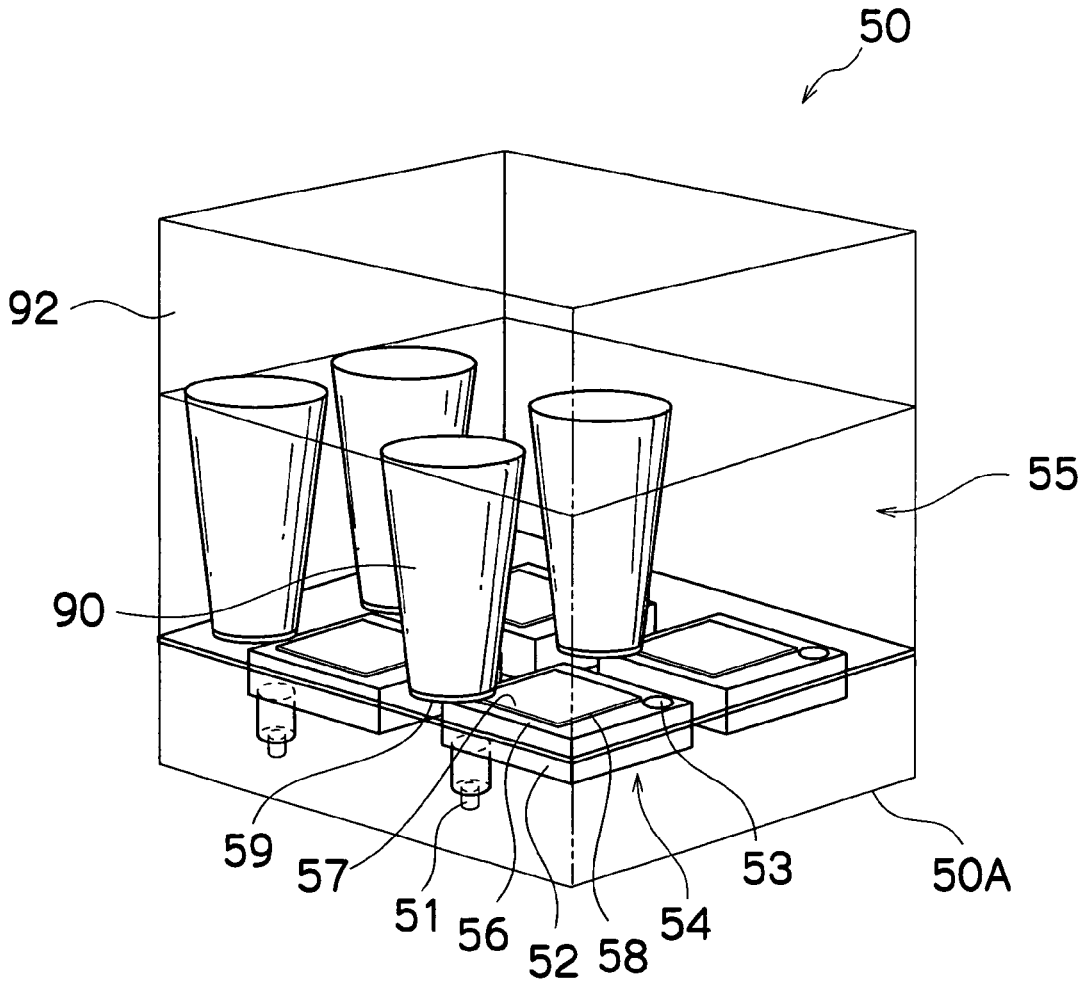
FIG. 4 is an oblique perspective diagram showing a portion of the schematic internal composition of the print head.

FIG. 4 is an oblique perspective diagram showing a portion of the schematic internal composition of the print head 50. The diagram includes four pressure chamber units 54, each constituted by a nozzle 51, a pressure chamber 52 and an ink supply port 53.

As shown in FIG. 4, in order of the upward direction in FIG. 4 from the nozzle surface 50A on which the nozzles 51 are formed, the print head 50 comprises: nozzles 51; pressure chambers 52 having an approximately cubic shape, which are connected respectively to the nozzles 51; a diaphragm 56 forming the ceilings of the pressure chambers; piezoelectric elements 58 disposed on the upper surface of the diaphragm 56; column-shaped piezoelectric element wires 90; and a multi-layer flexible cable 92. The space formed between the diaphragm 56 and the multi-layer flexible cable 92 is a common liquid chamber 55 which accumulates the ink to be supplied to the respective pressure chambers 52. Furthermore, ink supply ports 53 are formed respectively between the common liquid chamber 55 and each of the pressure chambers 52.

The piezoelectric element wires 90 are provided so as to pass through the common liquid chamber 55. Electrode sections (not shown in FIG. 4, but shown as a reference numeral 100 in FIG. 6) are formed inside the piezoelectric element wires 90, passing through the entire vertical length of the piezoelectric element wires 90. The piezoelectric element wires 90 may also be called "electrical columns", due to the shape of the piezoelectric element wire 90. Furthermore, as shown in FIG. 4, the piezoelectric element wires (electrical columns) 90 are formed in a tapered shape in such a manner that they broaden from the diaphragm 56 toward the multi-layer flexible cable 92. A method of manufacturing piezoelectric element wires 90 of this kind is described below.

The upper surface of each of the piezoelectric elements 58 is constituted by an individual electrode 57. An electrode pad 59 is formed on the outer side of a comer section of the individual electrode 57. The electrode pad 59 is formed integrally with the individual electrode 57. Incidentally, the electrode pads 59 may be formed independently and then connected electrically to the individual electrodes 57.

A piezoelectric element wire 90 is bonded to the upper surface of each of electrode pads 59. The bonding sections between the piezoelectric element wires 90 and the electrode pads 59 are sections which make contact with the ink accumulated in the common liquid chamber 55. The bonding method used in those bonding sections in order to ensure electrical conductivity while also guaranteeing insulation with respect to the ink is described below.

Figure 5:
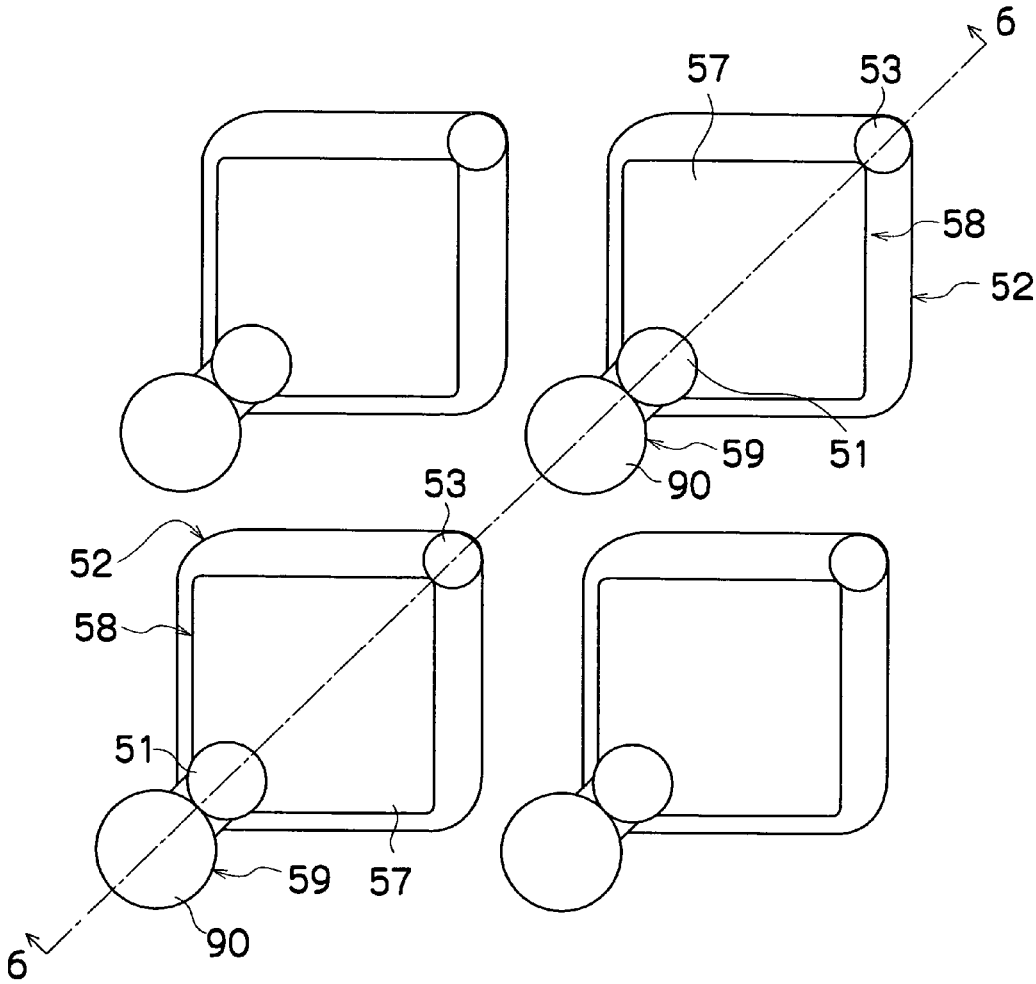
FIG. 5 is a plan view perspective diagram of the print head shown in FIG. 4.

FIG. 5 is a plan view perspective diagram of the print head 50 shown in FIG. 4. As shown in FIG. 5, the planar shape of the individual electrode 57 provided on the upper surface of each of the piezoelectric elements 58 is a substantially square shape which is approximately similar to the planar shape of the pressure chamber 52. The substantially circular electrode pad 59 is formed integrally with the individual electrode 57, in such a manner that the electrode pad 59 is extracted to the outside from the comer section of the individual electrode 57 adjacent to the nozzle 51.

Figure 6:
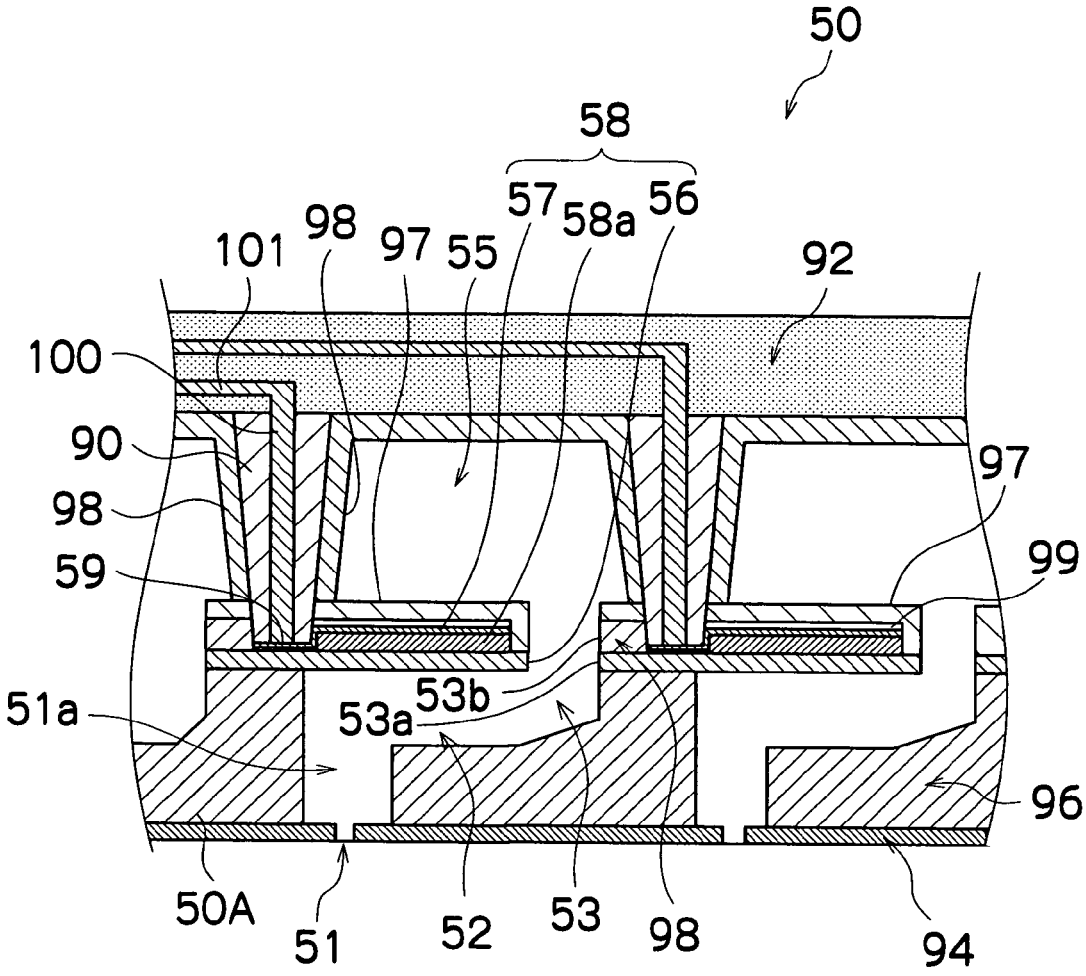
FIG. 6 is a cross-sectional diagram along line 6-6 in FIG. 5.

FIG. 6 is a cross-sectional diagram along line 6-6 in FIG. 5. As shown in FIG. 6, the print head 50 has a structure in which a plurality of thin layer-shaped plates are laminated together. More specifically, the following layers are laminated in the upward direction in FIG. 6, from the nozzle surface 50A: a nozzle plate 94 which forms the nozzles 51; a flow channel plate 96 which forms the nozzles 51, the pressure chambers 52, and the nozzle flow channels 51 a linking the pressure chambers 52 and nozzles 51; a diaphragm 56 which constitutes the ceiling of the pressure chambers 52; a piezoelectric element protection plate 97 which is disposed over the piezoelectric elements 58; and a multi-layer flexible cable 92 which is provided over the piezoelectric element wires 90. In FIG. 6, each of the plates is shown as a single plate, but those plates are respectively constituted by a plurality of plates, in actual fact.

In the diaphragm 56 constituting the ceiling of the pressure chambers 52, through holes 53*a* forming ink supply ports 53 which connect the common liquid chamber 55 with the pressure chambers 52 are formed at positions corresponding to the pressure chambers 52. In addition, similarly to the diaphragm 56, in the piezoelectric element protection plate 97 provided over the piezoelectric elements 58 on the diaphragm 56, other through holes 53*b* forming portions of the ink supply ports 53 are also formed at positions corresponding to the respective pressure chambers 52.

By means of this composition, the common liquid chamber 55 and the pressure chambers 52 are connected directly via the ink supply port 53. More specifically, in the print head 50, fluid connections are created between the common liquid chamber 55 and each of the pressure chambers 52.

Each of the piezoelectric element 58 disposed in a position opposing the pressure chambers 52 on the diaphragm 56, on the other side of the diaphragm 56 from the pressure chambers 52, is composed of a piezoelectric body 58*a* and an individual electrode 57 formed on the upper surface of the piezoelectric body 58*a*. In the present embodiment, the diaphragm 56 is formed by a thin film-shaped plate having electrical conductivity, made of stainless steel or the like, and the diaphragm 56 is used as a common electrode for driving the respective piezoelectric elements 58.

A piezoelectric element protection plate 97 made of stainless steel is formed over the piezoelectric elements 58. The piezoelectric element protection plate 97 functions as an insulating and protective film for protecting the piezoelectric elements 58 from the ink accumulated in the common liquid chamber 55 which is positioned above the piezoelectric element protective plate 97.

The piezoelectric element protective plate 97 is composed in such a manner that a gap 99 is formed between each piezoelectric element 58 and the piezoelectric element protection plate 97. Since the gap 99 reduces the resistance when driving the piezoelectric elements 58, the operation of the piezoelectric elements 58 is facilitated, thereby improving the drive efficiency of the piezoelectric elements 58.

The piezoelectric element wire 90 is bonded onto the upper surface of each of electrode pads 59, and is extracted to the outer side from the end section of each of the individual electrodes 57. The electrode sections 100 are formed inside the piezoelectric element wires 90, passing through the entire vertical length thereof, and are composed in such a manner that one end of each of the electrode sections 100 connects with the respective electrode pad 59. As described previously, since the electrode pads 59 are formed integrally with the individual electrodes 57, electrical connections are formed between the individual electrodes 57 of the piezoelectric elements 58 and the electrode sections 100 of the piezoelectric element wires 90.

The multi-layer flexible cable 92 has drive electrode sections 101 connected to the head driver 84 (see FIG. 2). An end of each of the drive electrode sections 101 is connected to the respective electrode section 100 provided in each of the piezoelectric element wires 90, thereby establishing electrical connections between the electrode sections 100 of the piezoelectric element wires 90 and the drive electrode sections 101 of the multi-layer flexible cable 92. Consequently, electrical connections are established from the head driver 84 to each of the individual electrodes 57, via the drive electrode sections 101 of the multi-layer flexible cable 92 and the electrode sections 100 of the piezoelectric element wires 90.

The common liquid chamber 55 is a space formed between the diaphragm 56 and the multi-layer flexible cable 92. Protective and insulating films 98 are formed on the sections which make contact with the ink, according to the diaphragm 56, the piezoelectric elements 58, the piezoelectric element protection plate 97, the piezoelectric element wires 90, and the multi-layer flexible cable 92, which constitute the common liquid chamber 55. As described above, if the piezoelectric element protection plate 97 functions as an insulating and protective film, then it is not necessary to form the insulating and protective film 98 on the surface of the piezoelectric element protection plate 97.

By means of this composition, when a drive signal for driving a piezoelectric element 58 is supplied from the head driver 84 (see FIG. 2), the drive signal is supplied to the individual electrode 57 from the drive electrode section 101 of the multi-layer flexible cable 92, via the electrode section 100 of the piezoelectric element wire 90.

When the drive signal is supplied to an individual electrode 57, the piezoelectric body 58*a* deforms, and the diaphragm 56 which constitutes the ceiling of the pressure chamber 52 also deforms. Thereby, the volume of the pressure chamber 52 decreases, and the ink accumulated inside the pressure chamber 52 is ejected via the nozzle flow channel 51*a* and out from the nozzle 51, in the form of an ink droplet.

In the print head 50 according to the present embodiment, the piezoelectric element wires 90 are provided so as to pass through the common liquid chamber 55, and wires for supplying drive signals to the respective piezoelectric elements 58 are provided in a multi-layer flexible cable 92 which is positioned above the piezoelectric element wires 90 (in the opposite direction to the pressure chambers 52). Therefore, it is possible to increase the density of wiring.

Furthermore, in the print head 50 according to the present embodiment, since a common liquid chamber 55 is provided on the opposite side of the diaphragm 56 from the pressure chambers 52, rather than being provided on the same side of the diaphragm 56 as the pressure chambers 52 as in the prior art, it is not necessary to provide complicated flow channels for guiding ink from the common liquid chamber 55 to the pressure chambers 52 as in the prior art. Additionally, it is also possible to increase the size of the common liquid chamber 55 in comparison with the prior art. Furthermore, the pressure chambers 52 and the common liquid chamber 55 disposed above the pressure chambers 52 are connected directly by means of ink supply ports 53, and the length of the nozzle flow channels 51 a from the pressure chambers 52 to the nozzles 51 are shorter than the length thereof in the prior art.

Consequently, the print head 50 is able to eject high-viscosity ink (for example, the ink having viscosities of 20 cp to 50 cp). Also, since ink refill can be performed rapidly after ejection, it is possible to drive the ejection at a high frequency.

When implementing the present invention, as shown in FIGS. 4 and 6, the common liquid chamber 55 is formed as a single large space which covers the entire region formed by all of the pressure chambers 52 in the print head 50, but the common liquid chamber 55 is not limited to a composition which is able to supply ink to all of the pressure chambers 52 in this way. A plurality of spaces also may be formed by dividing the common liquid chamber 55 into a number of regions.

Moreover, in the present embodiment, a composition is shown in which one piezoelectric element wire 90 is provided with respect to each electrode pad (in other words, each individual electrode 57), but the composition is not limited to those. One piezoelectric element wire 90 also may be formed corresponding to a plurality of piezoelectric elements 58. In this case, it is possible to further reduce the number of piezoelectric element wires (electrical columns) 90 formed in the print head 50.

There are no particular restrictions on the size of the print head 50 described above, but to give one example, the planar shape of the pressure chambers 52 is a square shape of 300 μm×300 μm, and the height of the pressure chambers is 150 μm. Also, each of the diaphragm 56 and the piezoelectric elements 58 has a thickness of 10 μm. Furthermore, the bonding section with the electrode pad 59 in the piezoelectric element wires 90 (electrical columns) has a diameter of 100 μm, and a height of the piezoelectric element wires 90 is 500 μm.

Method for Manufacturing Print Head

Next, a method of manufacturing a print head 50 of this kind will be described.

FIGS. 7A to 7D are illustrative diagrams showing steps of manufacturing a print head 50.

Figure 7A:
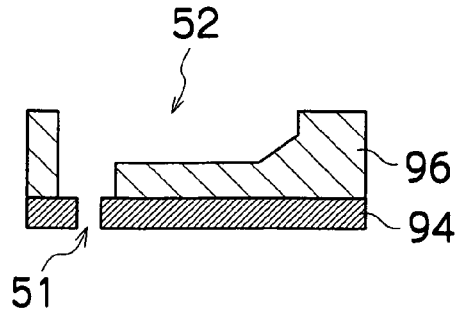
FIGS. 7A to 7D are illustrative diagrams showing steps of manufacturing a print head.

Firstly, as shown in FIG. 7A, a flow channel plate 96 constituting the pressure chambers 52 is formed by etching a plurality of plates which are made of stainless steel, or by silicon etching, or the like. Additionally, a nozzle plate 94 pierced with fine holes for forming nozzles 51 is made from polyimide, or the like. The nozzle plate 94 and the flow channel plate 96 are bonded together with an adhesive, or the like.

Figure 7B:
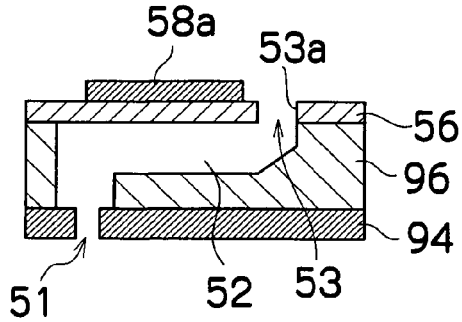

Next, as shown in FIG. 7B, a diaphragm 56 is bonded onto the flow channel plate 96. The through holes 53*a* are previously formed in the diaphragm 56 in respective positions corresponding to the ink supply ports 53 with respect to the pressure chambers 52.

Next, the thin film-shaped piezoelectric body 58*a* is formed by AD (aerosol deposition) or sputtering on the upper side of the diaphragm 56, in a position corresponding to each of the pressure chambers 52. The thin film-shaped piezoelectric bodies 58*a* also may be formed by grinding a bulk piezoelectric body. The diaphragm 56 is made of an electrically conductive member, which made to function as a common electrode corresponding to a plurality of piezoelectric bodies 58*a*.

Figure 7C:
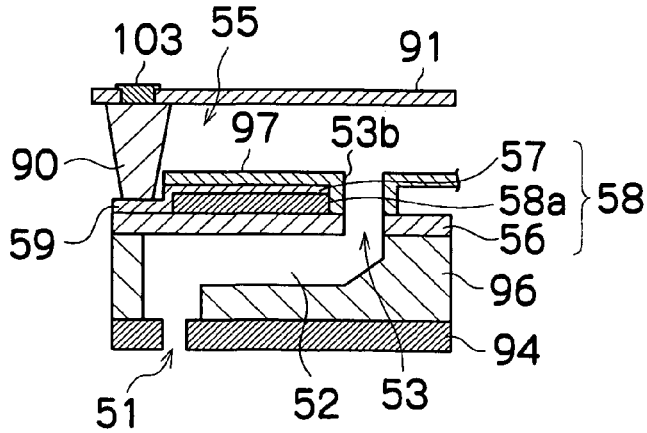

Next, as shown in FIG. 7C, the individual electrode 57 is formed on each of the piezoelectric bodies 58*a*. When forming the individual electrode 57, the electrode pad 59 is formed integrally with the individual electrode 57 by extracting one end of the individual electrode 57 to the outside. In this case, an insulating layer (not shown) is formed previously between the electrode pad 59 and the diaphragm 56. If both of the piezoelectric body 58*a* and the individual electrode 57 are extracted, then it is not necessary to provide an insulating layer.

The piezoelectric element protection plate 97 made of stainless steel is formed on the upper surface of the individual electrode 57. The through holes 53*b* are previously formed in the piezoelectric element protection plate 97 in respective positions corresponding to the ink supply ports 53 for the pressure chambers 52.

Next, the piezoelectric element wires 90 are formed on a wiring plate 91 so as to stand in a substantially perpendicular fashion. A method of manufacturing the piezoelectric element wires 90 of this kind is described below.

After forming the piezoelectric element wires 90 on the wiring plate 91, the front end of each of the piezoelectric element wires 90 is connected to an electrode pad 59. The bonding sections between the piezoelectric element wires 90 and the electrode pads 59 are sections which are soaked in the ink accumulated in the common liquid chamber 55. In order to ensure electrical conductivity while also guaranteeing insulation with respect to the ink, the bonding method used in those bonding sections is described below.

By bonding the front ends of the piezoelectric element wires 90 with the electrode pads 59, the common liquid chamber 55 is formed in a space between the diaphragm 56 and the wiring plate 91. Next, the protective and insulating film (not shown) is formed on the surfaces of the sections which make contact with the ink, according to the diaphragm 56, the piezoelectric elements 58, the piezoelectric element protection plate 97, the piezoelectric element wires 90, and the multi-layer flexible cable 92, which constitute the common liquid chamber 55. As described above, if the piezoelectric element protection plate 97 functions as an insulating and protective film, then it is not necessary to form the insulating and protective film 98 on the surface of the piezoelectric element protection plate 97.

Figure 7D:
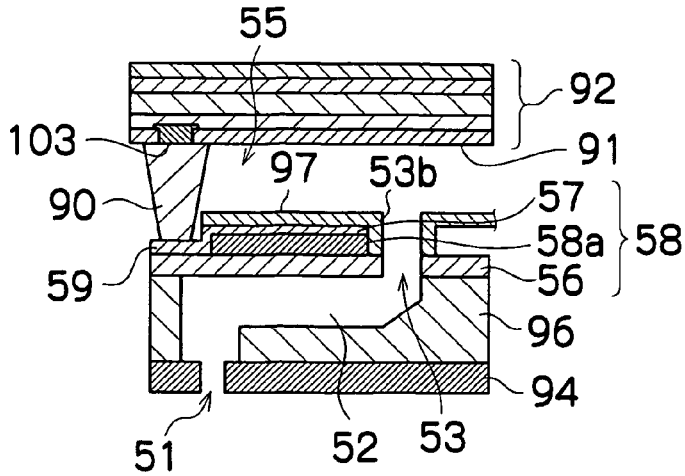

Finally, as shown in FIG. 7D, a multi-layer flexible cable 92 is attached to the upper side of the wiring plate 91. The multi-layer flexible cable 92 is formed by at least four layers. The piezoelectric element wires 90 are connected to the wires inside the multi-layer flexible cable 92 by means of solders 103 which are provided on the wiring plate 91 in positions corresponding to the piezoelectric element wires 90.

In this way, the print head 50 is formed in such a manner that the piezoelectric element wires 90 pass through a common liquid chamber 55.

Next, the method of manufacturing the aforementioned piezoelectric element wires 90 (electrical columns) will be described.

FIGS. 8A to 8E are illustrative diagrams showing steps of manufacturing piezoelectric element wires 90.

Figure 8A:
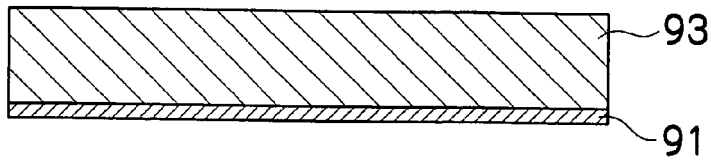
FIGS. 8A to 8E are illustrative diagrams showing steps of manufacturing piezoelectric element wires (electrical columns)

Firstly, as shown in FIG. 8A, a copper layer 93 having a thickness of approximately 500 μm is formed on the upper surface of a wiring plate 91 constituted by an insulating substrate.

Figure 8B:
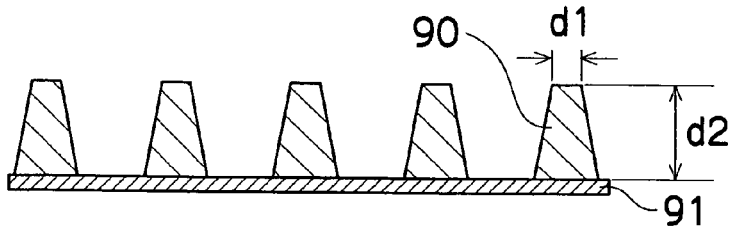

Next, as shown in FIG. 8B, the copper layer 93 is cut by etching, or the like, so as to form the column-shaped piezoelectric element wires 90. The piezoelectric element wires 90 are formed, for example, so that the front ends thereof are a diameter d1 of approximately 100 μm and a height d2 of approximately 500 μm, which is equal to the thickness of the copper layer 93.

Figure 8C:
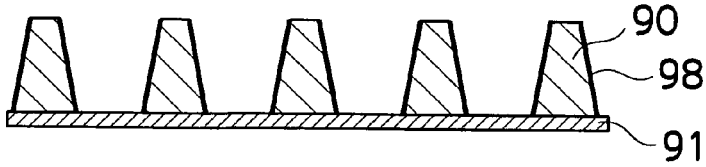

Next, as shown in FIG. 8C, the insulating and protective film 98 is coated onto the either side faces of the column-shaped electrical wires 90. As described above, since the piezoelectric element wires 90 constituted so as to pass through the common liquid chamber 55 always make contact with the ink, the insulating and protective film 98 is formed in order to protect the piezoelectric element wires 90.

Figure 8D:
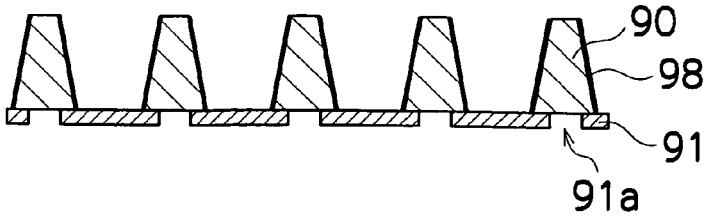

Next, as shown in FIG. 8D, the opening sections 91*a* passing through the entire vertical length of the wiring plate 91 are processed from the lower surface of the wiring plate 91, in positions corresponding to the piezoelectric element wires 90. Incidentally, the opening sections 91*a* may be processed in advance, before the step of forming the copper layer 93 on the wiring plate 91 as shown in FIG. 8A.

Figure 8E:
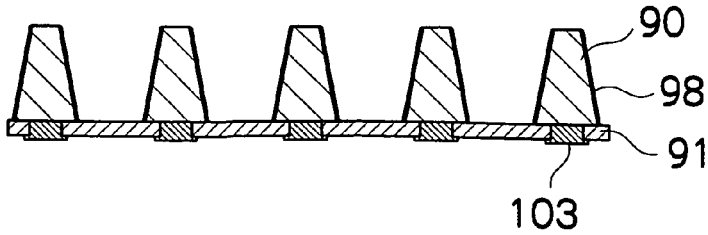

Finally, as shown in FIG. 8E, the solders 103 are introduced into the opening sections 91*a* formed in the wiring plate 91. In this way, piezoelectric element wires (electrical columns) 90 are formed on the wiring plate 91.

After the wiring plate 91 shown in FIG. 8E is inverted, the front ends of the piezoelectric element wires 90 are bonded with the electrode pads 59 on the diaphragm 56, as shown in FIG. 7C. Then, as shown in FIG. 7D, the multi-layer flexible cable 92 is bonded on top of the wiring plate 91, thereby forming a print head 50.

Incidentally, the wiring plate 91 and the multi-layer flexible cable 92 also may be bonded after bonding the piezoelectric element wires 90 individually to the respective electrode pads 59, rather than bonding the front ends of the piezoelectric element wires 90 to the electrode pads 59 after forming a plurality of piezoelectric element wires 90 on a wiring plate 91 as shown in FIGS. 7A to 7D. Although the bonding process requires significant time if the piezoelectric element wires 90 have been installed individually in this way, it is not necessary to be concerned about the positional accuracy when forming the piezoelectric element wires 90 onto the wiring plate 91.

Method for Bonding Piezoelectric Element Wires

The bonding sections between the piezoelectric element wires 90 and the electrode pads 59 are sections which are soaked in the ink accumulated in the common liquid chamber 55. In order to ensure electrical conductivity while also guaranteeing insulation with respect to the ink, the bonding method used in those bonding sections is described below.

Figure 9:
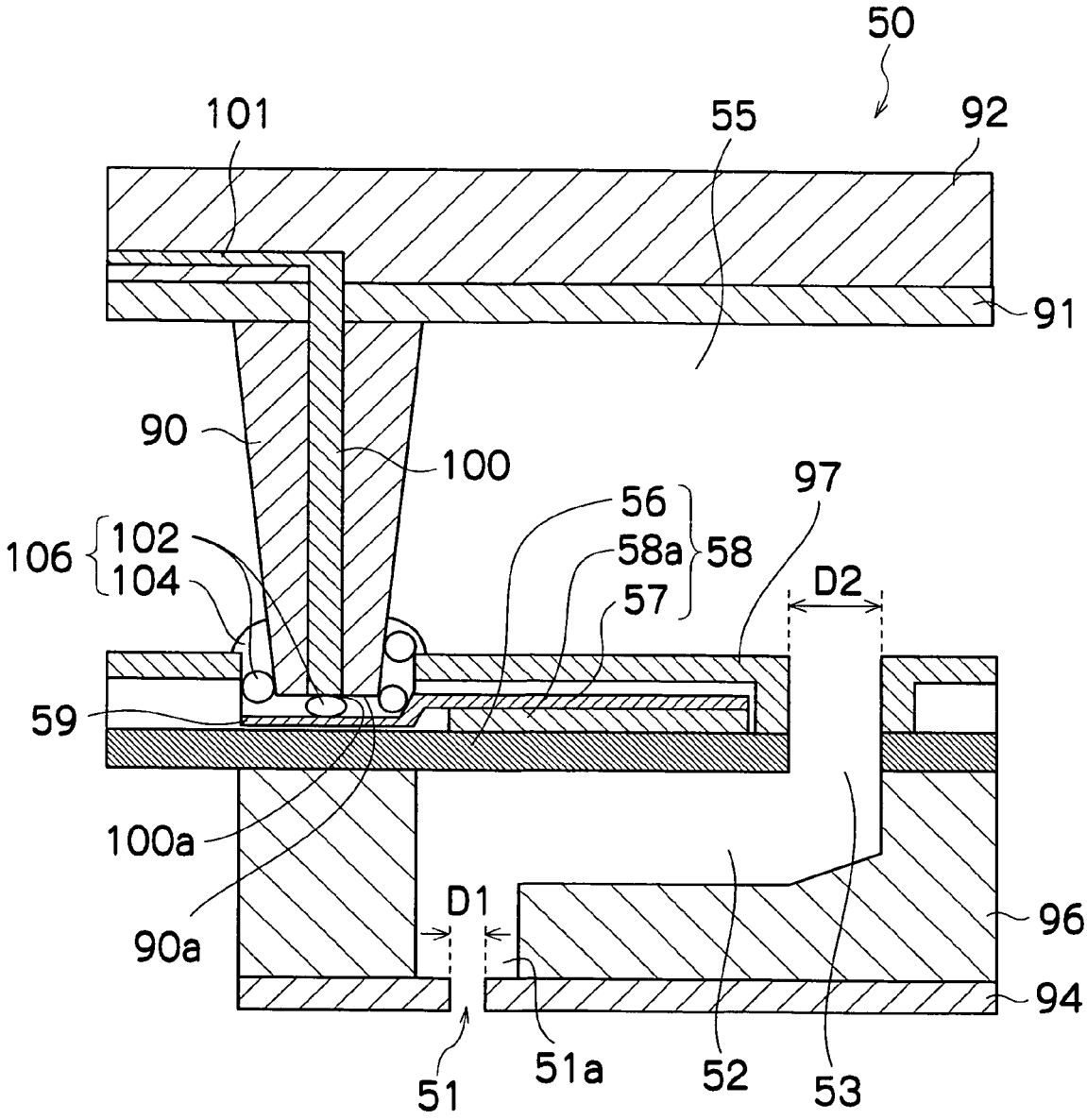
FIG. 9 is an enlarged diagram of a peripheral area of a bonding section between a piezoelectric element wire and an electrode pad according to a first embodiment of the present invention.

FIG. 9 is an enlarged diagram of a peripheral area of a bonding section between a piezoelectric element wire 90 and an electrode pad 59 in a first embodiment of the present invention.

The adhesive 106 used for connecting the piezoelectric element wires 90 with the electrode pads 59 is made of a non-conductive resin 104 which contains conductive particles 102. For example, a commercially available epoxy resin, such as anisotropically conductive adhesive, may be used as the adhesive 106. Epoxy-based adhesives have high chemical resistance, and as in the present embodiment, they are suitable for bonding piezoelectric element wires 90 which are soaked in the ink.

In the present embodiment, the front end 90*a* of the piezoelectric element wire 90 is bonded to the electrode pad 59 by means of an adhesive 106, as shown in FIG. 9.

In this case, the front end 100*a* of the electrode section 100 formed inside each piezoelectric element wire 90 is connected to the electrode pad 59 by means of conductive particles 102 contained in the adhesive 106. As described above, since the electrode pad 59 and the individual electrode 57 are formed integrally, electrical connections are established between the electrode section 100 of the piezoelectric element wire 90 and the individual electrode 57.

On the other hand, the vicinity of the bonding section between the front end 90*a* of the piezoelectric element wire 90 and the electrode pad 59 is covered by a non-conductive resin 104, thereby ensuring insulation from the ink.

In the present embodiment, the Young's modulus of the conductive particles 102 is lower than the Young's modulus of the piezoelectric element wire 90 or the electrode section 100 which is provided inside the piezoelectric element wire 90. If the Young's modulus of the conductive particles 102 is higher, then the piezoelectric element wire 90 or electrode section 100 will deform when pressure is applied during bonding, and this could lead to wiring disconnections, or the like. Therefore, it is desirable that the conductive particles 102 are softer than the piezoelectric element wire 90 or the electrode section 100.

Furthermore, taking the diameter of the conductive particles 102 to be "d", the diameter of the nozzle 51 to be "D1", and the surface roughness of the front end 100*a* of electrode section 100 to be "R", then it is possible to establish a following inequality (1):

$$D1>d>R. \quad (1)$$

In a print head 50 in which the piezoelectric element wires 90 and the electrode pads 59 are bonded together by adhesive 106, if the conductive particles 102 float up inside the ink accumulated in the common liquid chamber 55, then they may cause blocking of the nozzles 51, leading to ejection defects. In order to prevent ejection defects of this kind, the diameter d of the conductive particles 102 is set to be smaller than the diameter D1 of the nozzles 51.

Furthermore, if the diameter d of the conductive particles 102 is smaller than the surface roughness R of the front end 100*a* of the electrode section 100, then the conductive particles 102 may enter into gaps in the electrode section 100 due to the application of pressure during bonding, or the like, and hence they may not be pressurized sufficiently and a satisfactory electrical connection between the electrode section 100 and the electrode pad 59 may not be achieved. Therefore, it is necessary for setting the diameter d of the conductive particles 102 to be greater than the surface roughness R of the front end 100*a* of the electrode section 100.

In one example of the present embodiment, taking the diameter D of the nozzle 51 to be 20 μm, and the surface roughness R of the front end 100*a* of the electrode section 100 to be 0.1 μm, then according to the inequality (1), the conductive particles 102 are formed so as to have a diameter d within the range indicated by a following inequality (2):

$$20\ \mu m>d>0.1\ \mu m. \quad (2)$$

Taking account of the expulsion characteristics of the conductive particles 102 from the nozzle 51 and the bonding characteristics between the front end 100*a* of the electrode section 100 and the conductive particles 102, as well as ensuring adequate electrical connection between the electrode section 100 and the individual electrode 57, it is desirable that the diameter d of the conductive particles 102 should satisfy a following inequality (3):

$$10\ \mu m \geqq d \geqq 0.1\ \mu m. \quad (3)$$

Even more desirably, taking the diameter of the ink supply ports 53 to be D2, the diameter d of the conductive particles 102 in the present embodiment should satisfy a following inequality (4):

$$D1 > d > R \text{ and } D2 > d > R. \quad (4)$$

Accordingly, the conductive particles 102 which float up into the ink accumulated in the common liquid chamber 55 can be prevented from blocking the nozzles 51, while also preventing blockages at the ink supply ports 53.

In addition, when the piezoelectric element wires 90 and the electrode pads 59 are bonded together by means of adhesive 106, it is preferable to verify the electrical connectivity between the electrode sections 100 and the individual electrodes 57 before the adhesive hardens.

When bonding the piezoelectric element wires 90, it is important to establish secure electrical connections with the individual electrodes 57. If the check for electrical connectivity performed prior to setting of the adhesive 106 reveals that an electrical connection has not been established, then the piezoelectric element wires 90 and electrode pads 59 are separated and cleaned or the like, the bonding is attempted once again, and another check for electrical connectivity is made. Therefore, since it is possible to prevent wasteful consumption of constituent parts of the print head 50, the production yield for the print head 50 can be improved.

If a thermosetting adhesive 106 is used, then heat should be applied to set the adhesive 106 after once electrical connectivity has been verified. On the other hand, if an adhesive 106 which sets at normal temperature is used, then it needs to select an adhesive which has a setting time long enough to allow the electrical connectivity to be verified.

If using a thermosetting adhesive 106, a situation may arise in which the print head 50 is warped due to differences in the coefficient of thermal expansion, during the heating process for setting the adhesive 106. In cases of this kind, it is desirable to use an adhesive 106 which sets at normal temperature.

Next, a second embodiment of the present invention will be described.

Figure 10:
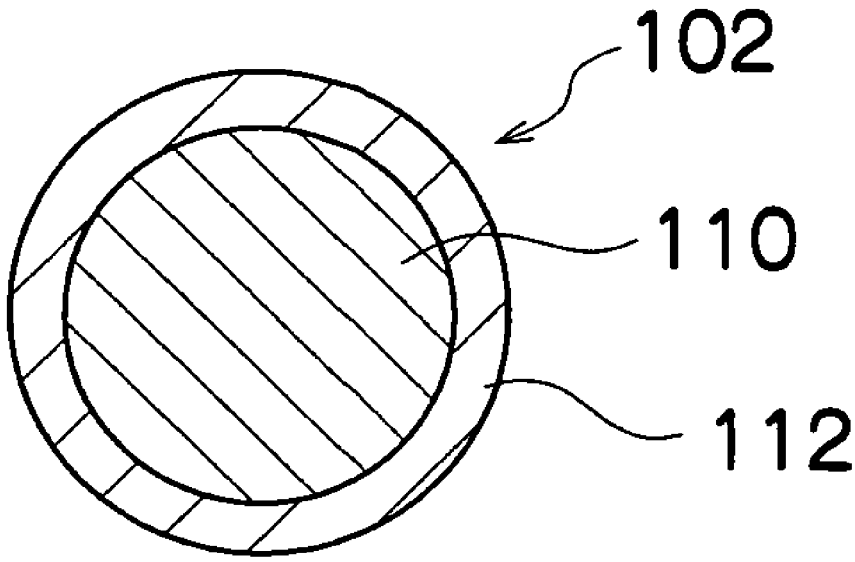
FIG. 10 is a cross-sectional diagram of a conductive particle according to a second embodiment of the present invention.

FIG. 10 is a cross-sectional diagram of a conductive particle 102 according to the second embodiment. As shown in FIG. 10, the conductive particles 102 of the present embodiment are constituted by a substantially spherical elastic body 110 and a metallic thin film 112 which is formed onto the outer circumferential surface of the elastic body 110 using a conductive metal. In one known conductive particle 102 of this kind, a Ni—Au electroless plating is formed onto a polystyrene sphere, for example.

Figure 11:
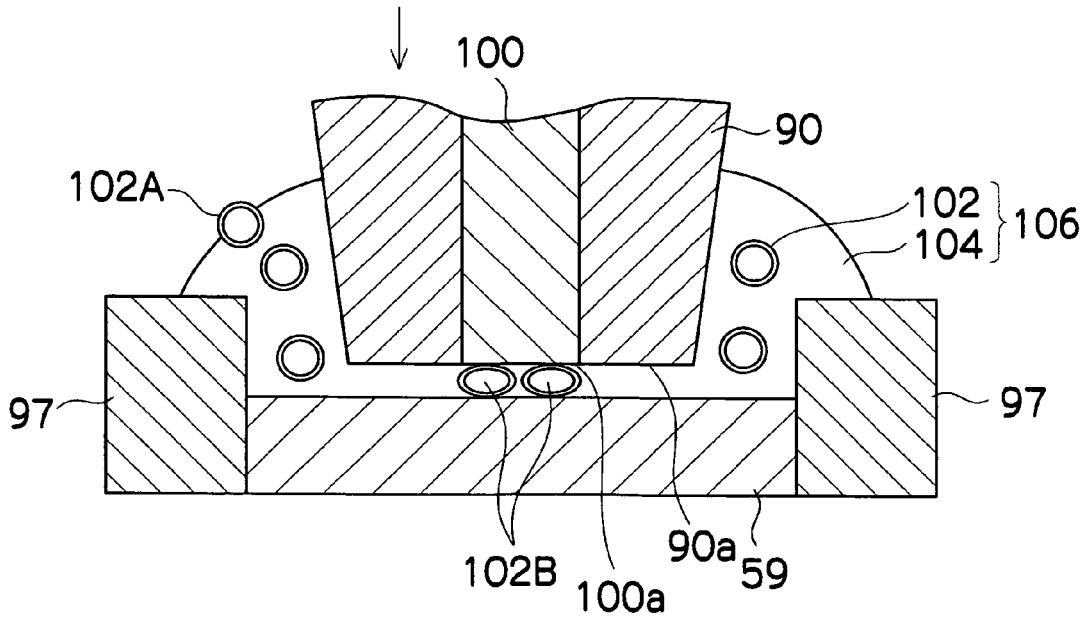
FIG. 11 is an enlarged diagram of a peripheral area of a bonding section between a piezoelectric element wire and an electrode pad in the second embodiment of the present invention.

FIG. 11 is an approximate diagram showing the periphery of a bonding section between a piezoelectric element wire 90 and an electrode pad 59 in a case in which an adhesive 106 containing a plurality of conductive particles 102 shown in FIG. 10 is used.

As shown in FIG. 11, when a piezoelectric element wire 90 and an electrode pad 59 are bonded together by means of an adhesive 106 containing the conductive particles 102 shown in FIG. 10, conductive particles 102B which are located between the front end 90*a* of the piezoelectric element wire 90 and the electrode pad 59 deform into an approximately elliptical shape, due to the pressure applied in the direction of an arrow in FIG. 11 during the bonding process.

By means of this deformation of the conductive particles 102B, it is possible to absorb any manufacturing variations in the heights of the piezoelectric element wires 90 (namely, the height d2 in FIG. 8B). Consequently, it is possible to reduce damage to the piezoelectric elements 58 caused by manufacturing variations. It is also possible to achieve reliable bonding between the piezoelectric element wires 90 and the electrode pads 59 corresponding respectively to same.

In particular, in the case of a composition in which the piezoelectric element wires 90 are positioned over the piezoelectric elements 58, rather than over electrode pads 59 disposed to the outer side of the piezoelectric elements 58 as shown in FIG. 4, even if a load is applied to the piezoelectric element wires 90, breakage of the piezoelectric elements 58 can be prevented by means of the deformation of the conductive particles 102 as shown in FIG. 11.

As described above, while the conductive particles 102 according to the present embodiment are relatively constituted by an elastic body 110, the surface of the elastic body 110 is coated with a metallic thin film 112, and then the Young's modulus of the conductive particles 102 is governed by the elastic body 110 and the conductivity of the conductive particles 102 is governed by the metallic thin film 112. Therefore, since it is possible to decide the Young's modulus and the conductivity of the conductive particles 102 independently, the potential range of design of the conductive particles 102 contained in the adhesive 106 can be increased.

Preferably, the metallic thin film 112 of the conductive particles 102 is coated with gold, which is chemically stable. As a reason of coating gold, there is a possibility that the conductive particles 102A may penetrate through the surface of the non-conductive resin 104 in the adhesive 106 applied to the periphery of the bonding section between the piezoelectric element wire 90 and the electrode pad 59 so as to making contact with the ink, as shown in FIG. 11.

Next, a third embodiment of the present invention will be described.

Figure 12:
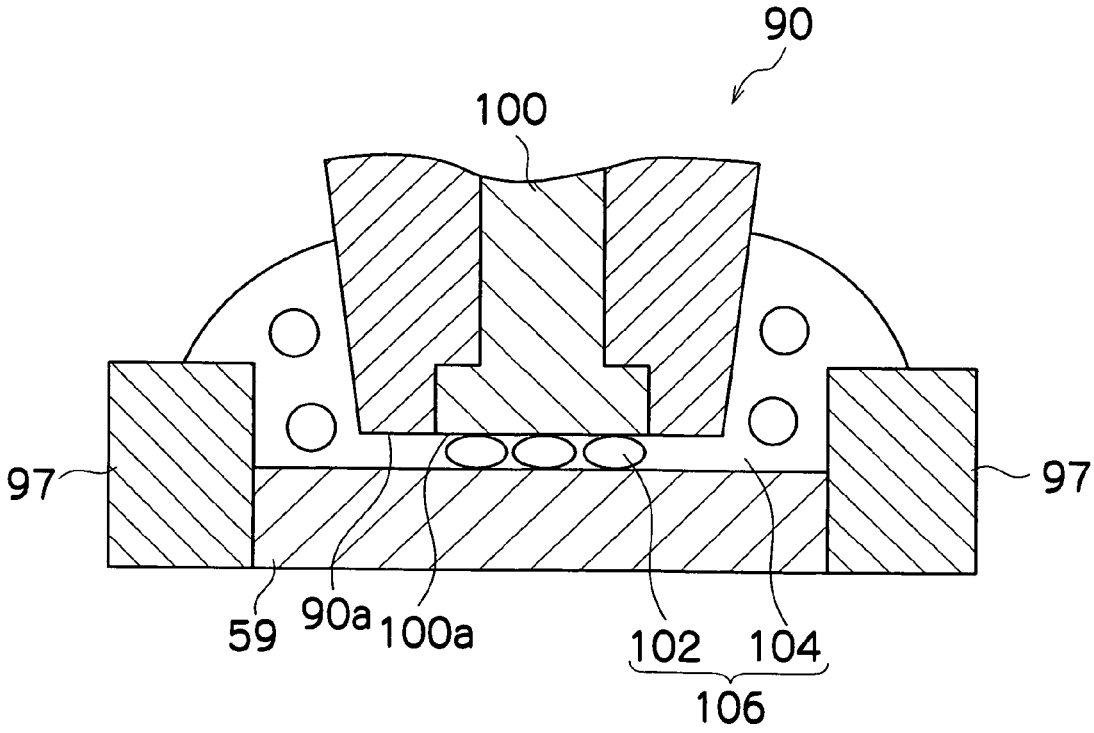
FIG. 12 is a cross-sectional diagram of a peripheral area of a bonding section between a piezoelectric element wire and an electrode pad in a third embodiment of the present invention, showing an example of a piezoelectric element wire.

FIG. 12 is a cross-sectional diagram of a peripheral area of a bonding section between a piezoelectric element wire 90 and an electrode pad 59 according to the third embodiment of the present invention. As shown in FIG. 12, the electrode section 100 of the piezoelectric element wire 90 according to the present embodiment has a different shape to the electrode section 100 according to the first embodiment (see FIG. 9). In the electrode section 100 according to the present embodiment, the front end 100*a* thereof broadens to form an approximate inverted T-shaped cross-section.

Figure 13:
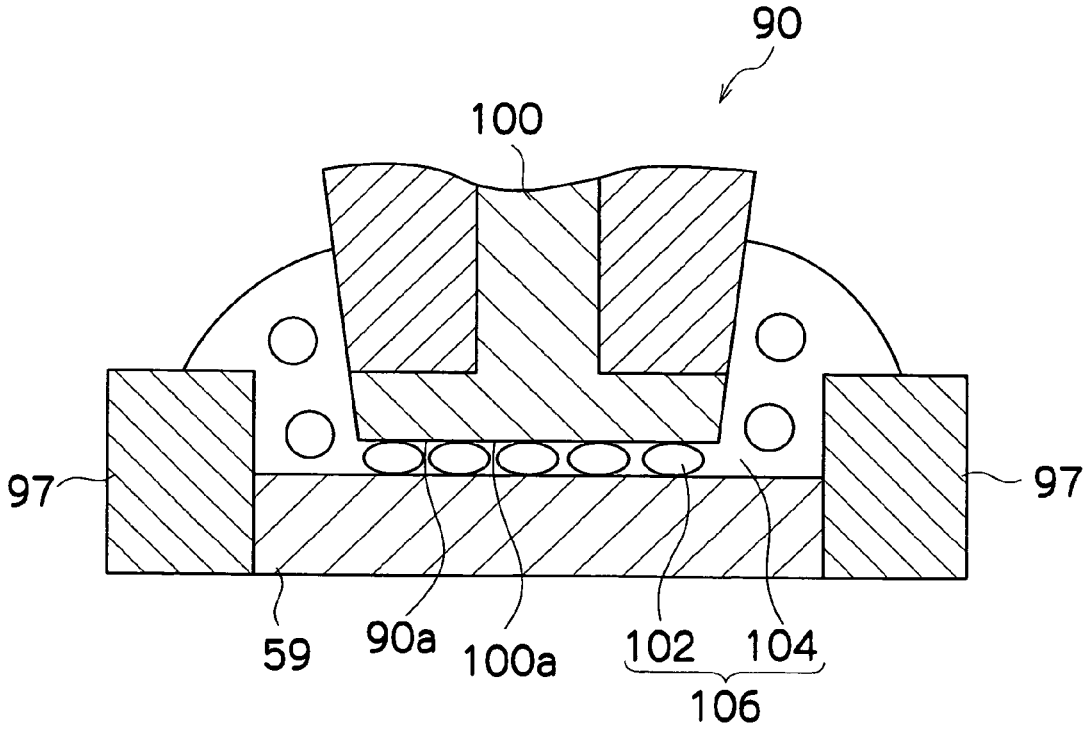
FIG. 13 is a cross-sectional diagram of the peripheral area of a bonding section between a piezoelectric element wire and an electrode pad according to the third embodiment of the present invention, showing another example of a piezoelectric element wire.

FIG. 13 is a partial cross-sectional diagram showing a further example of the piezoelectric element wire 90 according to the third embodiment. The electrode section 100 of the piezoelectric element wire 90 shown in FIG. 13 is an example in which the front end 100*a* of the electrode section 100 shown in FIG. 12 further broadens toward the side faces of the piezoelectric element wire 90.

The piezoelectric element wire 90 having an electrode section 100 with a broadened shape at the front end 100*a* thereof is bonded to an electrode pad 59 by means of an adhesive 106 comprising conductive particles 102 and a non-conductive resin 104, similarly to the first embodiment. It is also possible to use an adhesive 106 comprising elastic bodies 110 and metallic thin films 112 similar to those in the second embodiment (see FIGS. 10 and 11).

Since the piezoelectric element wires 90 of the third embodiment have a structure in which the front end 100*a* of the electrode section 101 broadens as shown in FIG. 12 or FIG. 13, then the surface area of the front end 100*a* which makes contact with the conductive particles 102 is increased, and therefore it can make contact with a greater number of conductive particles 102. In addition, since the contact surface area between the front end 100*a* of the electrode section 100 and the conductive particles 102 is greater than in the first embodiment, then the electrical contact resistance can be reduced. Therefore, it is possible to achieve more reliable electrical connections between the electrode sections 100 of the piezoelectric element wires 90 and the individual electrodes 57.

Next, a fourth embodiment of the present invention will be described.

Figure 14:
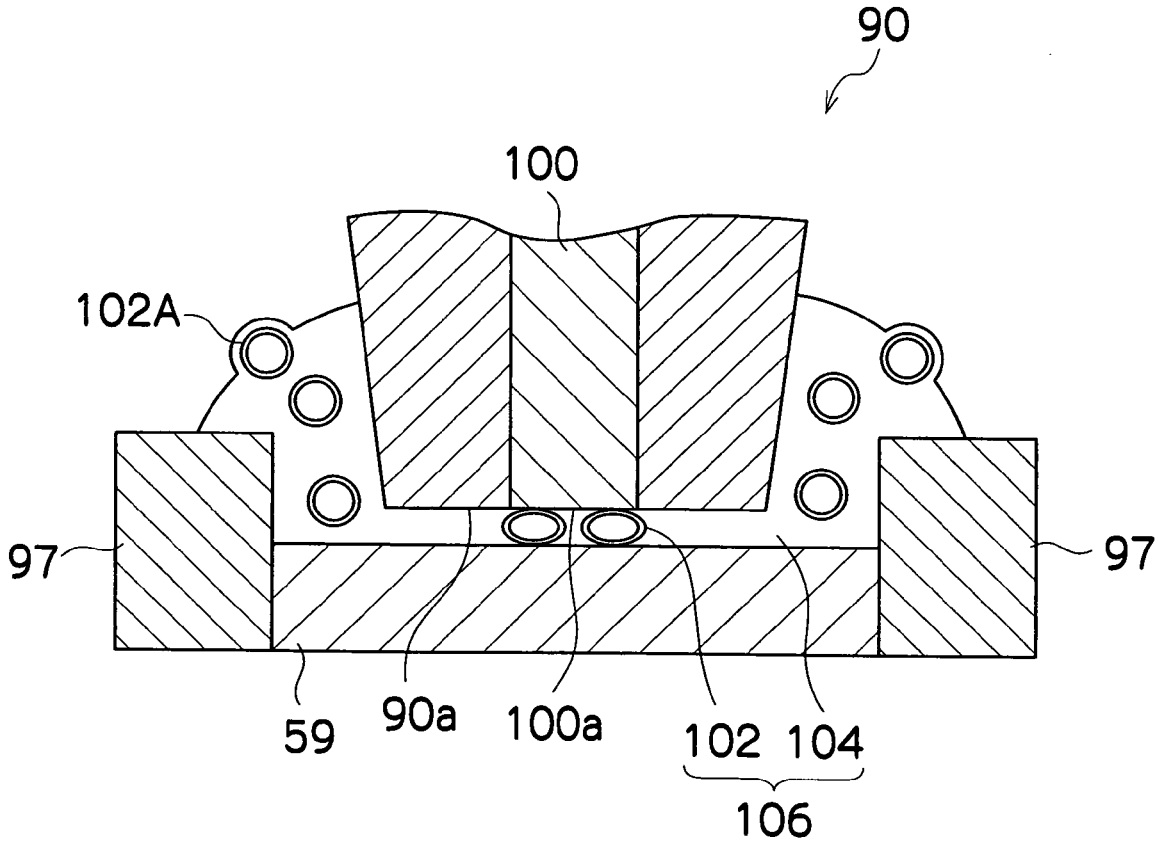
FIG. 14 is a cross-sectional diagram of a peripheral area of a bonding section between a piezoelectric element wire and an electrode pad according to a fourth embodiment of the present invention.

FIG. 14 is a cross-sectional diagram of a peripheral area of a bonding section between a piezoelectric element wire 90 and an electrode pad 59 according to the fourth embodiment of the present invention. In the present embodiment, the composition of the piezoelectric element wires 90 is approximately the same as that of the first and second embodiments, but the present embodiment differs in that the outer circumferential surfaces of the conductive particles 102 contained in the adhesive 106 are provided with a liquid attracting treatment.

By providing a liquid attracting treatment on the outer surfaces of the conductive particles 102, it is possible to improve wetting properties with respect to the non-conductive resin 104 in the adhesive 106. Therefore, the piezoelectric element wires 90 are bonded with the electrode pads 59 using an adhesive 106 containing a plurality of conductive particles 102 which have received a liquid attracting treatment in this manner.

If a conductive particle 102A projects outward from the surface of the non-conductive resin 104 as shown in FIG. 14, the outer surfaces of the conductive particles 102A remain covered with the non-conductive resin 104, due to the action of the liquid attracting treatment provided on the outer surfaces of the conductive particles 102A.

Then, since the adhesive 106 hardens in this condition, the conductive particles 102 do not make direct contact with the ink accumulated in the common liquid chamber 55, and there is no occurrence of conductive particles 102 separating from the adhesive 106 and floating up into the ink inside the common liquid chamber 55, or the like (see FIG. 9).

The foregoing description has explained about a bonding method in which reliable electrical connections can be ensured in the bonding sections between the piezoelectric element wires 90 and the electrode pads 59 while also ensuring insulation with respect to the ink, but the point of application of the present invention is not limited to the bonding sections between the piezoelectric element wires 90 and the electrode pads 59. The present invention may be adapted to any bonding sections that can ensure electrical connectivity and insulation with respect to ink. For example, if a composition is adopted in which the bonding sections between the piezoelectric element wires 90 and the multi-layer flexible cable 92 are soaked in the ink accumulated in the common liquid chamber 55, then the present invention can be applied suitably to these bonding sections.

The liquid ejection head, the image forming apparatus, and the method of manufacturing the liquid ejection head according to the present invention have been described in detail above, but the present invention is not limited to the aforementioned examples, and it is of course possible for improvements or modifications of various kinds to be implemented, within a range which does not deviate from the essence of the present invention.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a plate which has a plurality of ejection ports which eject a liquid;

a plurality of pressure chambers connected respectively to the ejection ports;

a plurality of piezoelectric elements which respectively deform the pressure chambers, the piezoelectric elements being provided on a side of the pressure chambers opposite to a side on which the ejection ports are formed;

a common liquid chamber which respectively supplies the liquid to the pressure chambers, the common liquid chamber being provided on the side of the pressure chambers opposite to the side on which the ejection ports are formed; and a plurality of wiring members which transfer a drive signal to the piezoelectric elements, the drive signal driving the piezoelectric elements for deforming the pressure chambers, wherein:

the wiring members are formed so that at least one portion of each of the wiring members rises upward through the common liquid chamber in a substantially perpendicular direction with respect to a surface on which the piezoelectric elements are disposed; and the wiring members are connected to the piezoelectric elements by means of an adhesive comprising a plurality of conductive particles and a non-conductive resin.

2. The liquid ejection head as defined in claim 1, wherein the conductive particles have elasticity.

3. The liquid ejection head as defined in claim 2, wherein a Young's modulus of the conductive particles is lower than a Young's modulus of the wiring members.

4. The liquid ejection head as defined in claim 3, wherein each of the conductive particles has a structure in which a surface of an elastic body is coated with a metal thin film.

5. The liquid ejection head as defined in claim 1, wherein:

a diameter of each of the conductive particles is smaller than an opening diameter of each of the ejection ports;

the diameter of each of the conductive particles is smaller than a diameter of a leading portion of each of the supply ports, the leading portion being portion which leads from the common liquid chamber to each of the pressure chambers in each of the supply ports; and the diameter of each of the conductive particles is greater than a surface roughness relating to the wiring members.

6. The liquid ejection head as defined in claim 1, wherein at least one end of an electrode section in the wiring members has a broadened shape.

7. The liquid ejection head as defined in claim 1, wherein the wiring members are formed so as to rise upward from the piezoelectric elements.

8. The liquid ejection head as defined in claim 1, wherein the wiring members are formed so as to rise upward from a vicinity of the piezoelectric elements.

9. The liquid ejection head as defined in claim 1, wherein:

the ejection ports are two-dimensionally arranged; and the wiring members are arranged two-dimensionally on a surface in which the piezoelectric elements are disposed.

10. An image forming apparatus, comprising a liquid ejection head which comprises: a plate which has a plurality of ejection ports which eject a liquid; a plurality of pressure chambers connected respectively to the ejection ports; a plurality of piezoelectric elements which respectively deform the pressure chambers, the piezoelectric elements being provided on a side of the pressure chambers opposite to a side on which the ejection ports are formed; a common liquid chamber which respectively supplies the liquid to the pressure chambers, the common liquid chamber being provided on the side of the pressure chambers opposite to the side on which the ejection ports are formed; and a plurality of wiring members which transfer a drive signal to the piezoelectric elements, the drive signal driving the piezoelectric elements for deforming the pressure chambers, wherein:

the wiring members are formed so that at least one portion of each of the wiring members rises upward through the common liquid chamber in a substantially perpendicular direction with respect to a surface on which the piezoelectric elements are disposed; and the wiring members are connected to the piezoelectric elements by means of an adhesive comprising a plurality of conductive particles and a non-conductive resin.

11. The image forming apparatus as defined in claim 10, wherein the conductive particles have elasticity.

12. The image forming apparatus as defined in claim 11, wherein a Young's modulus of the conductive particles is lower than a Young's modulus of the wiring members.

13. The image forming apparatus as defined in claim 12, wherein each of the conductive particles has a structure in which a surface of an elastic body is coated with a metal thin film.

14. The image forming apparatus as defined in claim 10, wherein:

a diameter of each of the conductive particles is smaller than an opening diameter of each of the ejection ports;

the diameter of each of the conductive particles is smaller than a diameter of a leading portion of each of the supply ports, the leading portion being portion which leads from the common liquid chamber to each of the pressure chambers in each of the supply ports; and the diameter of each of the conductive particles is greater than a surface roughness relating to the wiring members.

15. The image forming apparatus as defined in claim 10, wherein at least one end of an electrode section in the wiring members has a broadened shape.

16. The image forming apparatus as defined in claim 10, wherein the wiring members are formed so as to rise upward from the piezoelectric elements.

17. The image forming apparatus as defined in claim 10, wherein the wiring members are formed so as to rise upward from a vicinity of the piezoelectric elements.

18. The image forming apparatus as defined in claim 10, wherein:

the ejection ports are two-dimensionally arranged; and the wiring members are arranged two-dimensionally on a surface in which the piezoelectric elements are disposed.

19. A method of manufacturing a liquid ejection head, comprising the steps of:

causing a plate to form a plurality of ejection ports which eject a liquid;

providing a plurality of pressure chambers which are connected respectively to the ejection ports;

providing a plurality of piezoelectric elements on a side of the pressure chambers opposite to a side on which the ejection ports are formed;

providing a common liquid chamber on the side of the pressure chambers opposite to the side on which the ejection ports are formed, the common liquid chamber supplying the liquid respectively to the pressure chambers;

forming a plurality of wiring members in such a manner that at least a portion of each of the wiring members rises upward through the common liquid chamber in a substantially perpendicular direction with respect to a surface on which the piezoelectric elements are disposed, from the piezoelectric elements or a vicinity of the piezoelectric elements; and when the wiring members are bonded with the piezoelectric elements by means of an adhesive comprising a plurality of conductive particles and a non-conductive resin, verifying that electrical connections are established between electrode sections of the wiring members and the piezoelectric elements before hardening of the adhesive.

* * * * *